United States Patent [19]

Perkins et al.

[11] Patent Number: 4,669,667

[45] Date of Patent: Jun. 2, 1987

[54] NOZZLE FOR SPRAYING A LIQUID INTO A VESSEL OPENING

[75] Inventors: Haywood A. Perkins; Kenneth L. Ensley, both of Mobile, Ala.

[73] Assignee: Kerr-McGee Chemical Corporation, Oklahoma City, Okla.

[21] Appl. No.: 792,404

[22] Filed: Oct. 29, 1985

[51] Int. Cl.[4] ..... B05B 1/26; B05B 1/34

[52] U.S. Cl. ..... 239/467; 159/4.01; 159/48.1; 239/472

[58] Field of Search ..... 239/467, 472, 487, 489; 75/1 T, 101 R; 159/3, 4.01, 48.1

[56] References Cited

U.S. PATENT DOCUMENTS

| | | | |
|---|---|---|---|
| 2,428,748 | 10/1947 | Barz | 239/472 |
| 2,569,081 | 9/1951 | Veagh | 239/472 |
| 3,825,419 | 7/1974 | Chen | 75/101 R |
| 3,967,954 | 7/1976 | Chen | 75/1 T |
| 4,019,898 | 4/1977 | Chen et al. | 75/101 R |

FOREIGN PATENT DOCUMENTS

| | | | |
|---|---|---|---|
| 657858 | 4/1979 | U.S.S.R. | 239/489 |

*Primary Examiner*—Andres Kashnikow

*Attorney, Agent, or Firm*—William G. Addison

[57] ABSTRACT

A nozzle and a method for spraying a liquid into a vessel opening through such a nozzle wherein the nozzle includes a casing assembly and a core. The casing assembly has a casing opening which extends through the upper end of the casing assembly and extends a distance through the casing assembly and a discharge nozzle opening formed through a central portion of the lower end of the casing assembly. The core has an upper and a lower end and an outer peripheral surface and the core is disposed and supported within the casing opening generally between the upper and the lower ends of the casing and spaced a distance above the discharge nozzle opening. The core has swirl openings formed through the core intersecting the upper and the lower ends of the core and being disposed generally near the outer peripheral surface of the core and a central opening formed through a central portion of the core. The central opening and the swirl openings are sized and spaced about the outer peripheral surface of the core and the number of swirl openings is determined so the liquid discharged from the nozzle forms a substantially full cone distribution spray pattern.

6 Claims, 4 Drawing Figures

NOZZLE FOR SPRAYING A LIQUID INTO A VESSEL OPENING

BACKGROUND OF THE INVENTION

Field of the Invention

The present invention relates generally to nozzles for spraying a liquid and, more particularly, but not by way of limitation, to a nozzle for spraying a liquid into a vessel opening which is constructed so the liquid discharged from the nozzle forms a substantially full cone distribution spray pattern.

DESCRIPTION OF THE PREFERRED EMBODIMENT

In one preferred ilmenite beneficiation process for upgrading the titanium dioxide ($TiO_2$) content of ilmenite, the raw ilmenite is transferred to a reduction kiln wherein at least a portion of the ferric iron content is reduced to the ferrous state. The reduced ilmenite then is cooled and changed into a digester, to which hydrochloric acid is added. The digester is heated, and undergoes stirring or agitation, thereby promoting the leaching of dissolved iron values and the impurities from the reduced ilmenite ore.

After the desired degree of leaching has been achieved, the spent leach liquor is separated from the leached ilmenite, which comprises a solid phase in the digester. The leached ilmenite is calcined at a temperature of about 700° to about 1200° C. The product of this calcinate step is a beneficiated ilmenite, having an upgraded $TiO_2$ content.

The spent leach liquor recovered from the digester is regenerated to recover hydrochloric acid for re-use in the digestion step. Regeneration is carried out by transferring the spent leach liquor, which is rich in water, iron chlorides, and hydrochloric acid, to a roasting vessel, wherein the leach liquor is spray roasted at a temperature of about 650°–700° F. in the presence of air. This roasting step results in production of iron oxides, which are recovered as a solid residue from the roasting vessel, and hydrogen chloride. A high temperature overhead stream, rich in hydrogen chloride, water vapor and combustion gases is withdrawn from the roasting vessel and processed in one or more cyclones in order to remove any unrecovered iron oxide particles. The high temperature overhead stream then is transferred to a preconcentrator (vessel) 10 which is a contact heat exchanger. A process for the beneficiation of titaniferous iron ores and the regeneration of hydrochloric acid for reuse in the digestion step of the ilmenite process as generally described above are disclosed in U.S. Pat. Nos. 3,825,419, issued to Chen, 4,019,898, issued to Chen, et al., and 3,967,954, issued to Chen, all of which are owned by the assignee of the present invention and the disclosures in all of these references hereby specifically are incorporated herein by reference.

Figure 1:
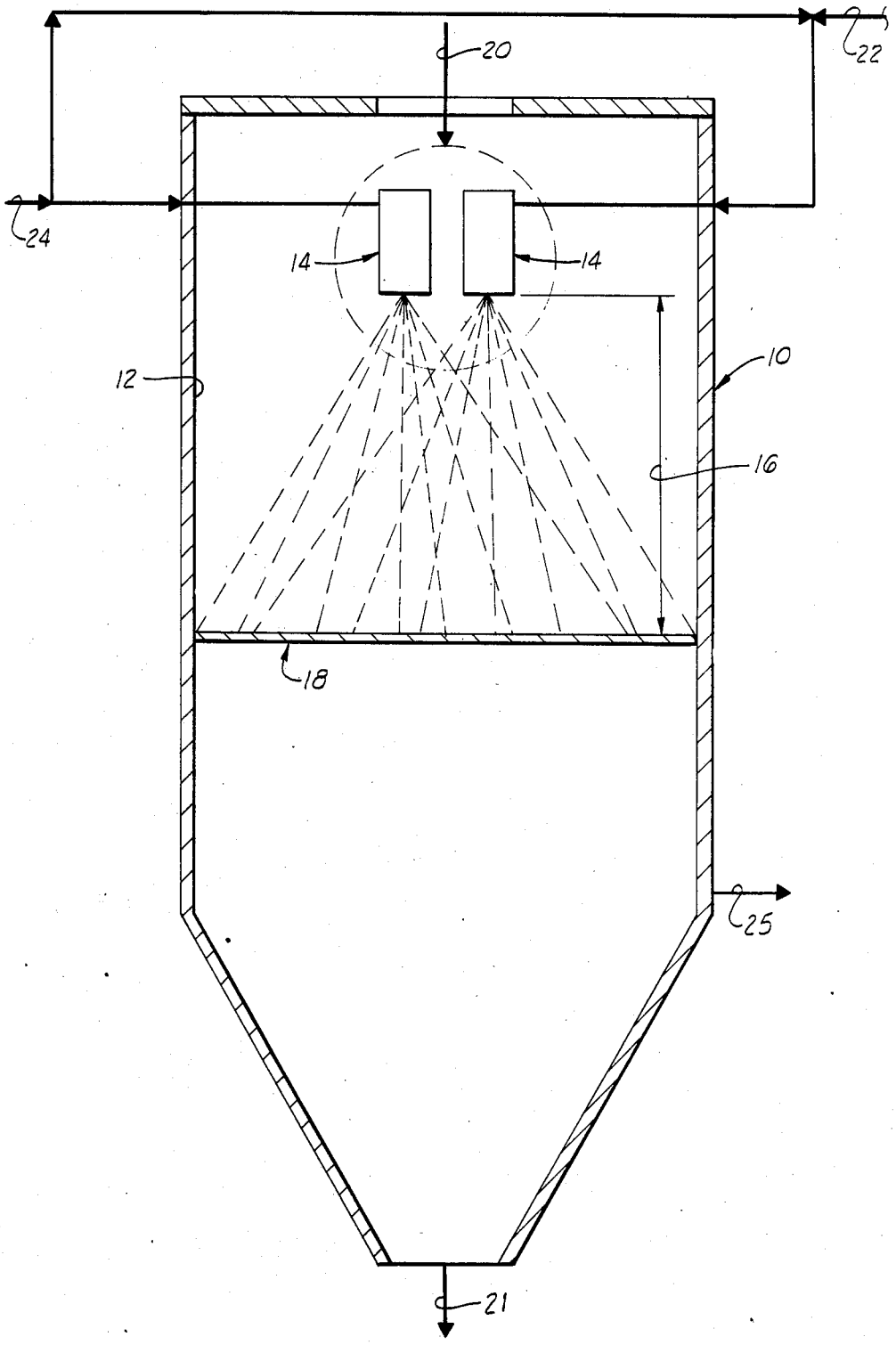
FIG. 1 is a diagrammatic schematic view of a vessel having two nozzles, each nozzle being constructed in accordance with the present invention and supported within the vessel opening.

Shown in FIG. 1 is a preconcentrator or vessel 10 which is utilized in the hydrochloric acid regeneration process generally described above. The preconcentrator (vessel) 10 is a vessel having a vessel opening 12 and, as shown in FIG. 1, a pair of nozzles are disposed and supported within the vessel opening 12 generally near the upper end of the vessel 10, each nozzle being designated in FIG. 1 by the reference numeral 14. The discharge end of each nozzle 14 is disposed a predetermined distance 16 generally above an impingement plate 18. In one embodiment, the impingement plate 18 is a circularly shaped plate which is disposed and supported within the vessel opening 12 and the impringement plate 18 includes a plurality of holes (not shown in the drawings) formed therethrough.

During the operation in the process for regenerating hydrochloric acid (spent leach liquor), the high temperature overhead stream, rich in hydrogen chloride water vapor and combustion gases from the roasting vessel is passed into the preconcentrator (vessel) 10 by way of the conduit 20. Spent leach liquor is passed into the preconcentrator (vessel) 10 by way of a conduit 22 and concentrated recycled liquor from the preconcentrator (vessel) 10 also is passed into the preconcentrator (vessel) 10 by way of a conduit 24. The conduits 22 and 24 are connected to each other and to each of the nozzles 14 so that, in operation, approximately equal amounts of recycle hydrochloric acid and spent hydrochloric acid are passed into each of the nozzles 14 by way of the conduits 22 and 24. Preconcentrated leach liquor is passed from the preconcentrator (vessel) 10 by way of a conduit 21 and the cooled gases goes to wet cyclones (not shown in the dawings) by way of a conduit 25.

Each of the nozzles 14 spray the solution of spent leach liquor and recycle leach liquor into the vessel opening 12 and onto the impingement plate 18 and the high temperature overhead stream also is passed through the vessel opening 12 and through the holes (not shown) in the impingement plate 18. Thus, the impingement plate 18 cooperates to bring the solution (spent leach liquor and recycle leach liquor) discharged from the nozzles 14 into intimate contact with the high temperature overhead stream which is passed through the vessel 10 from the conduit 20 when the preconcentrator (vessel) 10 is utilized in the hydrochloric acid regeneration process generally described before.

It is important that the liquid discharged from the nozzles 14 evenly cover the entire surface area of the impingement plate 18, otherwise the efficiency of the preconcentrator (vessel) 10 as a heat exchanger substantially is reduced. Each of the nozzles 14 of the present invention specifically are designed to provide a liquid discharge in the form of a substantially full cone distribution spray pattern so that the liquid discharged from each of the nozzles 14 evenly covers the impingement plate 18 with the discharged liquid.

It should be noted that, in the embodiment of the invention shown in the drawings, two nozzles 14 are located in the preconcentrator (vessel) 10. However, each of these nozzles 14 is designed to discharge liquid in a substantially full cone distribution spray pattern over the entire surface area of the impingement plate 18 and it would be possible to utilize only one nozzle 14. The utilization of two nozzles 14 has been found to be preferable so that the nozzles 14 continue to function in the above described manner even though one of the nozzles 14 may become partially clogged during the operation of the preconcentrator (vessel) 10 in the hydrochloric acid regeneration process described before.

Figure 2:
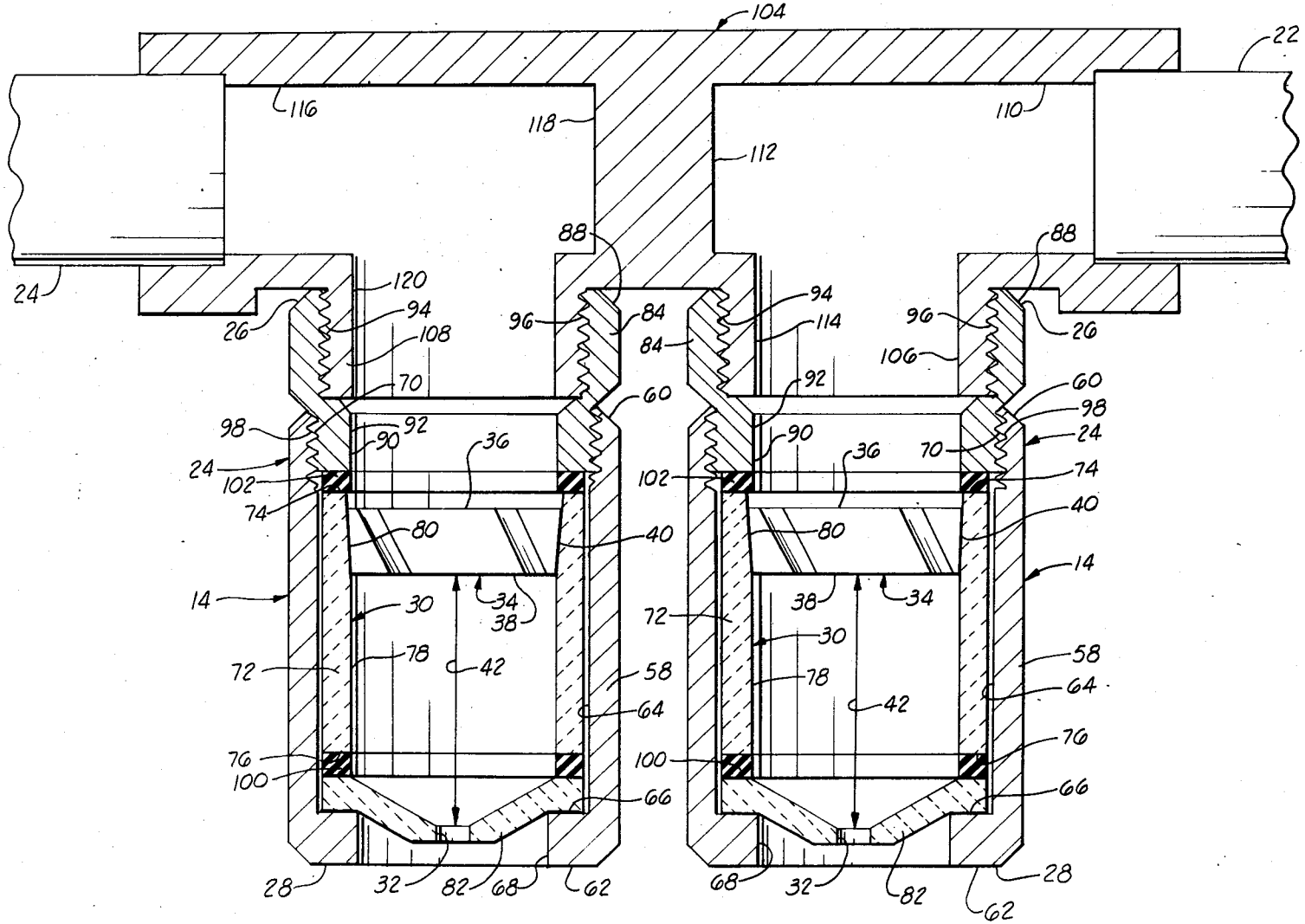
FIG. 2 is a sectional view showing the two nozzles which are diagrammatically shown in FIG. 1 supported within the vessel opening.

The nozzles 14 are shown more clearly in FIG. 2 and each of the nozzles 14 is identical in construction. Each nozzle 14 includes a casing assembly 24 having an upper end 26, a lower end 28 and a casing opening 30 extending through the upper end 26 and extending a distance through the casing assembly 24 generally toward the lower end 28 thereof. A discharge nozzle opening 32 is formed through a central portion of the lower end 28 of each of the casing assemblies 24.

Each nozzle 14 also includes a core (shown in FIG. 2 and shown in greater detail in FIGS. 3 and 4) 34 having an upper end 36, a lower end 38 and an outer peripheral surface 40. Each core 34 is disposed and supported within the casing opening 30 of one of the casing assemblies 34 generally between the upper and the lower ends 26 and 28 of the casing assembly 24, and the lower end 38 of each core 34 is spaced a distance 42 generally above one of the respective discharge nozzle openings 32. As shown more clearly in FIGS. 3 and 4, each core 34 has three swirl openings 44, 46 and 48 formed through a portion of the core 34 and each of the swirl openings 44, 46 and 48 extends through the core 34 intersecting the upper and the lower ends 36 and 38 of the core 34. Each core 34 also includes a central opening 50 which extends through a central portion of the core 34, the central opening 50 also intersecting the upper and the lower ends 36 and 38 of the core 34.

Each core 34 thus is generally cylindrically shaped and has a core axis 52 defined by a centerline extending through a central portion of the core 34 generally between the upper and the lower ends 36 and 38 of the core 34. In a preferred embodiment as shown more clearly in FIGS. 2 and 3, the central opening 50 is generally circularly shaped in cross section and has a centerline axis which coincides with the core axis 52. Each of the swirl openings 44, 46 and 48 extends through the core 34 at an angle 54 (shown in FIG. 4 with respect to the swirl opening 48) to the core axis 52. The swirl openings 44, 46 and 48 are spaced at equidistant positions generally about the outer peripheral surface 40 of the core 34 with each swirl opening 44, 46 and 48 being spaced about 120° from each of the other adjacent swirl openings 44, 46 and 48. The angle 54 is sized and the swirl openings 44, 46 and 48 are positioned through the core 34 so the liquid passing through the swirl openings 44, 46 and 48 is discharged into the portion of the casing opening 30 extending between the lower end 28 of the core 34 and the discharge nozzle opening 32 at a predetermined angle to impart a rotational or swirling movement to the liquid discharged from the swirl openings 44, 46 and 48 into the portion of the casing opening 30 generally between the lower end 28 of the core 34 and the discharge nozzle opening 32.

Figure 3:
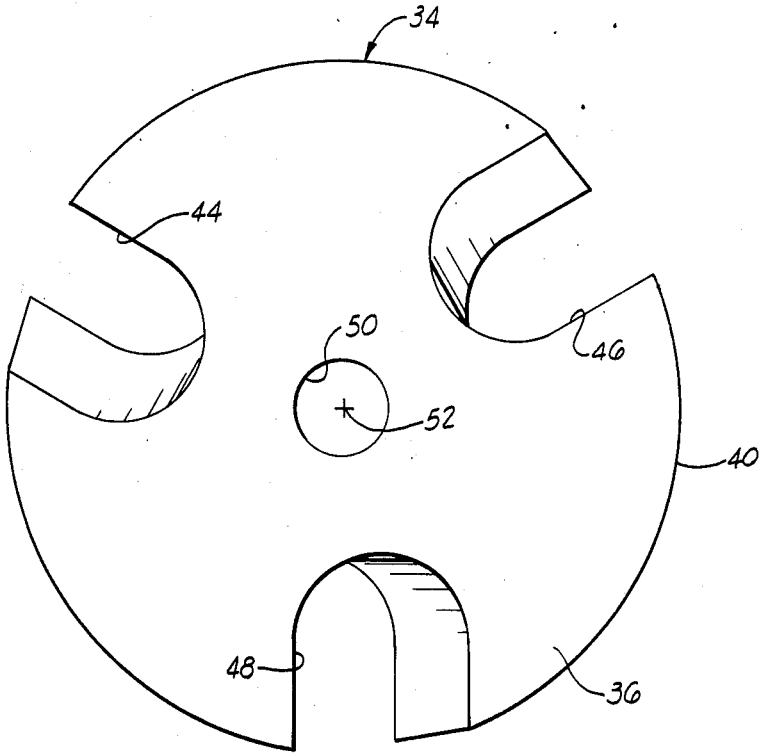
FIG. 3 is a top plan view of the core which is a portion of each of the nozzles shown in FIGS. 1 and 2.
Figure 4:
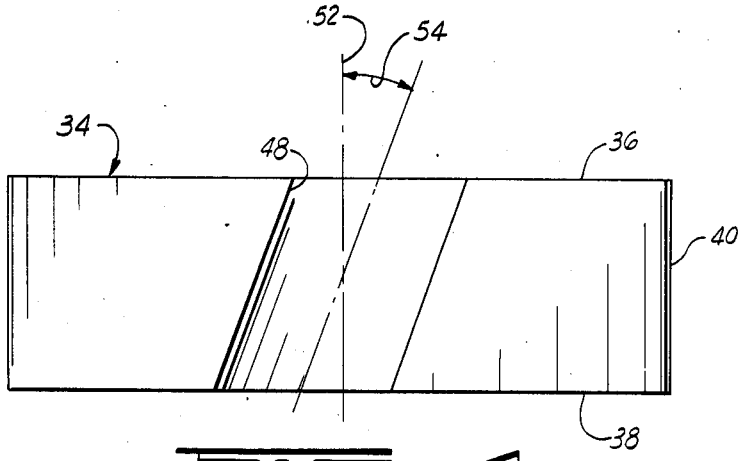
FIG. 4 is a side elevational view of the core portion shown in FIG. 3.

As shown more clearly in FIGS. 3 and 4, the outer peripheral surface 40 of each core 34 preferably is tapered so that the diameter of the core 34 generally near the upper end 36 is larger than the diameter of the core 34 generally near the lower end 38, for reasons which will be made more apparent below.

As shown more clearly in FIG. 2, each casing assembly 24, more particularly, includes a casing 58 having an upper end 60, a lower end 62 and an opening 64 which intersects the upper end 60 of the casing 58 and extends a distance through the casing 58 terminating with a lower surface or ledge 66 which extends circumferentially about the opening 64 and spaced a distance generally above the lower end 62 of the casing 58. An opening 68 is formed through a central portion of the lower end 62 of the casing 58 and the opening 68 extends a distance through the casing 58 and intersects the opening 64 in the casing 58. A threaded portion 70 is formed on a portion of the inner peripheral surface formed in the casing 58 by the opening 64 generally near the upper end 60 of the casing 58 for reasons which will be made more apparent below.

Each casing assembly 24 also includes a liner 72 having an upper end 74, a lower end 76 and an opening 78 extending axially therethrough and intersecting the upper and the lower ends 74 and 76 thereof. A portion of the inner peripheral surface formed in the liner 72 by the opening 78 generally near the upper end 74 of the liner 72 is tapered to form a tapered portion 80 generally near the upper end 74 of the liner 72. The liner 72 is generally cylindrically shaped and has a diameter formed by the outer peripheral surface thereof which is slightly smaller than the diameter formed by the inner peripheral surface formed in the casing 58 by the opening 68 in the casing 58 so that, in an assembled position, the liner 72 is disposed generally within a portion of the opening 64 in the casing 58.

Each casing assembly 24 also includes an orifice plate 82 which is generally circularly shaped. The diameter formed by the outer peripheral surface of the orifice plate 82 is slightly smaller than the diameter formed by the inner peripheral surface in the casing 58 formed by the opening 64 extending through the casing 58 so that, in an assembled position, the orifice plate 82 is disposed generally within the opening 64 in the casing 58 with a portion of the orifice plate 82 being disposed generally adjacent the lower surface or ledge 66 formed in the casing 58. A central portion of the orifice plate 82 is tapered generally downwardly toward the center of the orifice plate 82 and the discharge nozzle opening 32 is formed through a central portion of the orifice plate 82.

Each casing assembly 24 also includes a casing cap 84 which is generally cylindrically shaped and has an upper end 88 and a lower end 90. An opening 92 extends through a central portion of the casing cap 84 intersecting the upper and the lower ends 88 and 90 thereof. A recess 94 is formed through the upper end 88 of the casing cap 84 and extends a distance through the casing cap 84 generally toward the lower end 90. A portion of the inner peripheral surface formed in the casing cap 84 by the recess 94 is threaded to provide a threaded portion 96, and a portion 98 of the outer peripheral surface of the casing cap 84 generally near the lower end 90 of the casing cap 84 also is threaded.

In an assembled position of the casing assembly 24, the orifice plate 82 is disposed in the opening 64 of the casing 58 and positioned generally adjacent the lower surface or ledge 66 formed in the casing 58. A seal member 100 then is placed generally on top of the orifice plate 82 and the liner 72 then is inserted into the opening 64 in the casing 58 to a position wherein the lower end 76 of the liner 72 rests on and is disposed generally adjacent the seal member 100. A seal member 102 then is placed on the upper end 74 of the liner 72, the seal member 102 also being disposed within the opening 64 of the casing 58. The lower end 90 of the casing cap 84 then is screwed into the upper end 60 of the casing 58 with the threaded portion 98 of the casing cap 84 threadedly engaging the threaded portion 70 formed in the inner peripheral surface of the casing 58 near the upper end 60 thereof. The casing cap 84 is threaded into the casing 58 to a position wherein the lower end 90 of the casing cap 84 engages the seal member 102 and the casing cap 84 thus cooperates with the lower surface or ledge 66 to secure the liner 72, the orifice plate 82, and the seal members 100 and 102 in an assembled position within the opening 64 in the casing 58.

In an assembled position of the casing 58, the liner 72, the orifice plate 82 and the casing cap 84, the opening 78 in the liner 72 and the opening 92 in the casing cap 84 cooperate to form the casing opening 30. Prior to installing the seal member 102 and the casing cap 84 or prior to installing the liner 72 within the opening 64 in the casing 58, the core 34 is disposed within the opening 78 in the liner 72 with the tapered portion 80 in the liner 72 cooperating with the tapered outer peripheral surface of the core 34 to wedge the core 34 into position within the liner 72 opening 78.

In an assembled position of the casing assembly 24, the casing assembly 24 is screwed onto a manifold 104 (shown in FIG. 2). The manifold 104 is generally rectangularly shaped and includes a pair of generally circularly shaped protrusions 106 and 108 which extend a distance from the outer peripheral surface of the manifold 104. The outer peripheral surface of each of the protrusions 106 and 108 is threaded. Thus, more particularly, one casing assembly 24 is connected to the manifold 104 by threadedly engaging the threaded portion 96 of the casing cap 84 onto the threaded portions of the protrusion 106 and the other casing assembly 24 is connected to the manifold 104 by threadedly engaging the threaded portions 96 of the casing cap 84 to the threaded portions of the protrusion 108 thereby securing each of the casing assemblies 24 or, in other words, securing each of the nozzles 14 to the manifold 104.

The manifold 104 includes a first opening 110 which extends through one end of the manifold 104, the first opening 110 extending a distance through the manifold 104 terminating with a wall 112. An opening 114 is formed through a central portion of the protrusion 106 and the opening 114 in the protrusion 106 is in communication with the first opening 110 in the manifold 104.

A second opening 116 is formed through one end of the manifold 104, opposite the end of the manifold 104 having the first opening 110 formed therethrough, and the second opening 116 extends a distance through the manifold 104 terminating with a wall 118. An opening 120 is formed through a central portion of the protrusion 108 and the opening 120 in the protrusion 108 is in communication with the second opening 116 in the manifold 104.

One end of the conduit 22 extends through an opening (not shown) in the preconcentrator (vessel) 10 wall and into the vessel opening 12 to a position wherein that end of the conduit 22 is connected to the manifold 104 with the opening through the conduit 22 being in fluidic communication with the first opening 110 in the manifold 104. The conduit 24 extends through an opening (not shown) in the preconcentrator (vessel) 10 wall to a position wherein that end of the conduit 24 is connected to one end of the manifold 104 so that the opening through the conduit 24 is in fluidic communication with the second opening 116 in the manifold 104. Thus, the conduits 22 and 24 cooperate with the manifold 104 to support the nozzles 14 in a predetermined position within the vessel opening 12. It should be noted that the conduits 22 and 24 can be connected to the manifold 104 either by screwing (not shown) the end of the conduits 22 and 24 into the manifold 104 or by a flange connection (not shown) formed on the ends of the conduits 22 and 24 and mating flanges (not shown) formed on the manifold 104.

In operation, the mixture of spent liquor and recycle liquor is passed through the conduits 22 and 24 and a portion of this mixture is passed through the first opening 110 in the manifold 104, through the opening 114 in the protrusion 106, through the casing opening 30 of one of the casing assemblies 24 and discharged through the discharge nozzle opening 32 of that casing assembly 24. Another portion of the mixture of spent leach liquor and recycle leach liquor passes through the conduit 24 and into the second opening 116 in the manifold 104, through the opening 120 in the protrusion 108, through the casing opening 30 in the other casing assembly 24 and through the discharge nozzle opening 32 in that casing assembly 24.

In each of the nozzles 14, the fluid passes through a portion of the casing opening 30 generally near the upper end 26 of the casing assembly 24, through the swirl openings 44, 46 and 48 and through the central opening 50 of the core 34. The fluid is discharged from the swirl openings 44, 46 and 48 and from the central opening 50 into the portion of the casing opening 30 generally between the lower end of the core 34 and the orifice plate 82, the swirl openings 44, 46 and 48 and the central opening 50 cooperating to discharge the fluid in a rotating or swirling pattern into the portion of the casing opening 30 generally between the lower end 38 of the core 34 and the orifice plate 82. The fluid is discharged then through the discharge nozzle opening 32 in the orifice plate 82 in a full cone spray pattern.

In one preferred form where the nozzle 14 is utilized in the process for regenerating hydrochloric acid, as generally described before, the casing 58 is formed of a graphite, the casing cap 84 is formed of a graphite, the liner 72 is a ceramic and the orifice plate 82 also is a ceramic. The seal members 100 and 102 each are high temperature rubber or neopreme type seals.

In one preferred embodiment, the core 34 has an outside diameter generally near the upper end 36 of the core of $3\frac{5}{8}$ inches and an outside diameter generally near the lower end 38 of the core 34 of $3\frac{5}{8}$ inches. The discharge nozzle opening 32 is 2 inches in diameter. In this embodiment, the core 34 has a height of $1\frac{1}{8}$ inch. The diameter of the central opening 50 is $\frac{1}{2}$ inch and the swirl openings 44, 46 and 48 are each formed through the core 34 with a $\frac{7}{8}$ inch drill at an angle 54 of 20°, each swirl opening 44, 46 and 48 being spaced a distance of 13/16th of an inch from the core axis 52. In this embodiment, the lower end 38 of the core 34 is disposed a distance 42 of $4\frac{1}{2}$ inches to 5 inches above the discharge nozzle opening 32 formed through the orifice plate 82. Further, in this embodiment, the spray angle of the fluid being discharged from the discharge nozzle opening 32, which is circularly shaped and has a diameter of 2 inches, is at a spray angle equal to or greater than 50° (the spray angle of this particular nozzle 14 being about 71° which is more than sufficient to effectively cover the entire surface area of the impingement plate 18) and the nozzle 14 pressure is about 30 psi. In this embodiment, the impringement plate 18 has an outer diameter of 59 inches and has 1852 holes with each hole having a diameter of 37/64 inches and with the outer circle of holes being spaced about a diameter of 56 inches. The inner diameter of the preconcentrator (vessel) 10 is slightly greater than 59 inches and the distance between the lower ends of the nozzles 14 and the upper surface of the impingement plate 18 is 60 inches.

Utilizing the nozzles 14 of the present invention, a full cone spray pattern is achieved whereas the prior nozzles provided a hollow cone distribution spray pattern, and the nozzles 14 of the present invention thus provide a better and more even distribution of the discharged fluid over the entire upper surface are of the impingement plate 18. The hot gases from the roaster passing through the conduit 20 make better contact with the recycled and spent leach liquor discharged from the nozzles 14 as such gases pass through the impingement plate 18. To achieve this contact using the prior nozzles, several holes in the impingement plate were plugged which resulted in a higher pressure drop across the impingement plate 18 and, thus, less production. This problem was eliminated by the improved nozzles 14 of the present invention.

Changes may be made in the various elements, assemblies and components described herein and changes may be made in the steps or in the sequence of steps of the methods described herein without departing from the spirit and scope of the invention as defined in the following claims.

What is claimed is:

1. A nozzle for spraying a liquid, comprising:

a casing assembly having an upper end, a lower end, a casing opening extending a distance therethrough intersecting the upper end thereof, and a discharge nozzle opening formed through a central portion of the lower end of the casing assembly, the liquid being passable through the upper end of the casing assembly and through the casing opening and dischargable through the discharge nozzle opening during the operation of the nozzle for spraying a liquid; and a core having an upper end, a lower end and an outer peripheral surface, the core being disposed and supported within the casing opening generally between the upper and the lower ends of the casing assembly and spaced a distance above the discharge nozzle opening, the core having three swirl openings with each swirl opening being formed through the core intersecting the upper and the lower ends of the core and being disposed generally near the outer peripheral surface of the core, each swirl opening extending through the core at an angle to a core axis defined by a centerline extending through a central portion of the core generally between the upper and the lower ends of the core, the angle being sized so the liquid passing through each of the swirl openings is discharged into the portion of the casing opening extending between the core and the discharge nozzle opening at a predetermined angle to impart a rotational movement to the liquid discharged from the swirl openings into the portion of the casing opening generally between the core and the discharge nozzle opening, the swirls openings being spaced at equidistant positions generally about the outer peripheral surface of the core, each swirl opening being spaced about 120° from each of the other adjacent swirl openings, and a central opening formed through a cental portion of the core, the central opening being generally circularly shaped and extending generally perpendicularly through the core, the centerline axis of the central opening being generally aligned with the core axis extending through a central portion of the core generally between the upper and the lower ends of the core, the central opening being sized and the swirl openings being sized and spaced about the outer peripheral surface of the core so the liquid is passable through the upper end of the casing assembly and through a portion of the casing opening and through the swirl openings and the central opening in the core and through a portion of the casing opening and dischargable through the discharge nozzle so the liquid discharged from the discharge nozzle forms a substantially full cone distribution spray pattern.

2. The nozzle of claim 1 wherein the core is defined further as being generally cylindrically shaped with the upper and the lower ends of the core being generally circularly shaped in a plan view.

3. A nozzle adapted for use in a vessel having a vessel opening for spraying a liquid into the vessel opening, comprising:

a casing assembly having an upper end, a lower end, a casing opening extending a distance therethrough intersecting the upper end thereof, and a discharge nozzle opening formed through a central portion of the lower end of the casing assembly, the liquid being passable through the upper end of the casing assembly and through the casing opening and dischargable through the discharge nozzle opening during the operation of the nozzle for spraying a liquid;

means for supporting the casing assembly at a predetermined position within the vessel opening for discharging the liquid through the nozzle opening at a predetermined position within the vessel opening; and a core having an upper end, a lower end and an outer peripheral surface, the core being disposed and supported within the casing opening generally between the upper and the lower ends of the casing assembly and spaced a distance above the discharge nozzle opening, the core having three swirl openings with each swirl opening being formed through the core intersecting the upper and the lower ends of the core and being disposed generally near the outer peripheral surface of the core, each swirl opening extending through the core at an angle to a core axis defined by a centerline extending through a central portion of the core generally between the upper and the lower ends of the core, the angle being sized so the liquid passing through each of the swirl openings is discharged into the portion of the casing opening extending between the core and the discharge nozzle opening at a predetermined angle to impart a rotational movement to the liquid discharged from the swirl openings into the portion of the casing opening generally between the core and the discharge nozzle opening, and a central opening formed through a central portion of the core, the central opening being generally circularly shaped and extending generally perpendicularly through the core, the centerline axis of the central opening being generally aligned with the core axis extending through a central portion of the core generally between the upper and the lower ends of the core, the central opening being sized and the number of swirl openings being determined and the swirl openings being sized and spaced about the outer peripheral surface of the core so that liquid is passable through the upper end of the casing assembly and through a portion of the casing opening and through the swirl openings and the central opening in the core and through a portion of the casing opening and dischargable through the discharge nozzle opening so the liquid discharge from the discharge nozzle opening forms a substantially full cone spray pattern.

4. The nozzle of claim 3 wherein the core is defined further as being generally cylindrically shaped with the upper and the lower ends of the core being generally circularly shaped in a plan view.

5. The nozzle of claim 3 wherein the vessel is defined further as including an impingement plate disposed and supported within a portion of the vessel opening and wherein the means for supporting the casing assembly within the vessel is defined further as supporting the casing assembly at a predetermined position within the vessel opening generally above the impingement plate, the liquid being discharged through the discharge nozzle opening onto the impingement plate and wherein the number of swirl openings is determined and the swirl openings and the central opening in the core are further defined as being sized and positioned in the core so the liquid discharged from the discharge nozzle opening forms a substantially full cone distribution spray pattern covering substantially the entire surface area of the impingement plate.

6. A method for making a nozzle for spraying a liquid wherein the nozzle includes a casing assembly having an upper end, a lower end, a casing opening extending a distance therethrough intersecting the upper end thereof, and a discharge nozzle opening formed through a central portion of the lower end of the casing assembly, and wherein a core is disposed in the casing opening generally between the upper and the lower ends of the casing assembly and spaced a distance above the discharge nozzle opening, the method comprising:

forming three swirl nozzle openings in the core with each swirl nozzle opening being formed through the core and intersecting the upper and the lower ends of the core and being disposed generally near the outer peripheral surface of the core each swirl opening extending through the core at an angle to a core axis defined by a centerline extending through a central portion of the core generally between the upper and the lower ends of the core, the angle being sized so that liquid passing through each of the swirl openings is discharged into the portion of the casing opening extending between the core and the discharge nozzle opening at a predetermined angle to impart a rotational movement to the liquid discharged from the swirl openings into the portion of the casing opening generally between the core and the discharge nozzle opening; and forming a central opening through the core the central opening being generally circularly shaped and extending generally perpendicularly through the core, the centerline axis of the central opening being generally aligned with the core axis extending through a central portion of the core generally between the upper and the lower ends of the core, and sizing the central opening in the core and sizing the swirl openings in the core so liquid passing through the upper end of the casing assembly and through a portion of the casing opening and through the swirl openings and central opening in the core and through a portion of the casing opening and discharged through the discharge nozzle opening in the casing assembly is discharged through the discharge nozzle opening in the casing assembly in a substantially full cone distribution spray pattern.

* * * * *